United States Patent [19]

Rottigni

[11] 4,229,999

[45] Oct. 28, 1980

[54] VALVE ADJUSTMENT TOOL

[76] Inventor: Joseph G. Rottigni, 3659 Greenwood Ter., Chalfont, Pa. 18914

[21] Appl. No.: 47,311

[22] Filed: Jun. 11, 1979

[51] Int. Cl.[3] ..... B25F 1/00

[52] U.S. Cl. ..... 81/3 F; 7/100; 7/138; 7/165

[58] Field of Search ..... 7/100, 138, 165; 81/3 F, 113; 279/42, 43

[56] References Cited

U.S. PATENT DOCUMENTS

| | | | |
|---|---|---|---|
| 1,544,520 | 6/1925 | Putrow | 81/3 F X |
| 2,561,407 | 7/1951 | Palmer | 81/113 |
| 2,601,796 | 7/1952 | Palesh, Jr. | 81/3 F |

FOREIGN PATENT DOCUMENTS

| | | | |
|---|---|---|---|
| 1221806 | 1/1960 | France | 81/113 |

*Primary Examiner*—James G. Smith
*Attorney, Agent, or Firm*—Robert J. Mooney

[57] ABSTRACT

The valve adjustment tool includes an elongated barrel having a bore therethrough. The upper portion of the barrel is provided with a tool land and a length of external threads. The lower end of the barrel is provided with an integral collet which forms a nut socket. The collet is surrounded by a compression collar. An elongated internally threaded sleeve overlays the barrel. The sleeve abuts the compression collar. When the sleeve is threaded downwardly on the barrel, the collar compresses the collet. When the sleeve is threaded upwardly on the barrel, the collar is free to move and the collet assumes its uncompressed state. An elongated valve adjuster driver is also provided. The driver is provided with a large disc shaped knob at its upper end and an engagement lug at its lower end. The driver normally reposes within the through-bore of the barrel and is rotatable therein and removable therefrom. The top of the disc shaped knob provides a landing for the foot of a dial indicator.

4 Claims, 3 Drawing Figures

VALVE ADJUSTMENT TOOL

BACKGROUND OF THE INVENTION

This invention relates to valve adjustment tools.

The present method of adjusting the valves of automotive engines is quite time consuming. The presently used method requires that the mechanic loosen the valve adjuster lock nut, rotate the valve adjuster stem with a screw driver, tighten the valve adjuster lock nut and then check the adjustment by placing the foot of a dial indicator on the relatively small diameter valve adjuster stem or by inserting a feeler gauge between the valve adjuster and the rocker arm. In most, if not all, cases the mechanic must repeat the foregoing process several times in the course of adjusting just one valve.

Accordingly, it is an object of this invention to provide a valve adjustment tool which allows the user thereof to simultaneously measure and adjust clearances. It is another object of this invention to provide a valve adjustment tool which allows the user to untighten and tighten a valve stem lock nut and to adjust and simultaneously measure clearances without removing the tool from engagement with the lock nut during the adjustment and measuring operation. These and other objects are achieved as follows.

SUMMARY OF THE INVENTION

The valve adjustment tool includes an elongated barrel having a bore therethrough. The upper portion of the barrel is provided with a tool land and a length of external threads. The lower end of the barrel is provided with an integral collet which forms a valve lock nut socket. The collet is surrounded by a compression collar. An elongated internally threaded sleeve overlays the barrel. The sleeve abuts the compression collar. When the sleeve is threaded downwardly on the barrel, the collar compresses the collet. When the sleeve is threaded upwardly on the barrel, the collar is free to move and the collet assumes its uncompressed state. An elongated valve adjuster driver is also provided. The driver is provided with a large disc shaped knob at its upper end and an engagement lug at its lower end. The driver normally reposes within the through-bore of the barrel and is rotatable therein and removable therefrom. The top of the disc shaped knob provides a landing for the foot of a dial indicator.

The device of this invention permits tightening and loosening of the valve adjuster lock nut and concommitant adjustment of the valve adjuster while the foot of dial indicator is effectively in measuring contact with the valve adjuster stem by virtue of the fact that the foot of the dial indicator rests on the disc shaped knob of the valve adjuster driver.

DESCRIPTION OF THE PREFERRED EMBODIMENT

Figure 2:
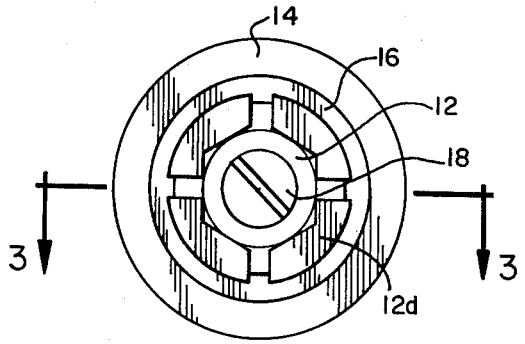
FIG. 2 is an end view of the device shown in FIG. 1 taken along the lines 2—2 in FIG. 1.
Figure 3:
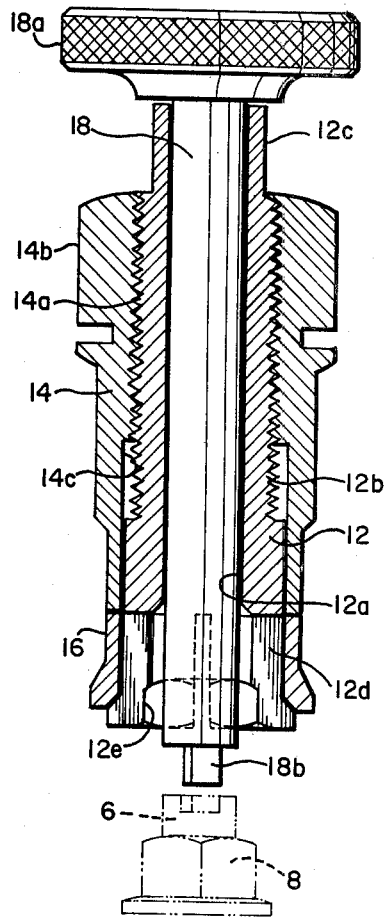
FIG. 3 is a sectional view of the device shown in FIGS. 1 and 2 taken along the lines 3—3 in FIG. 2.
Figure 1:
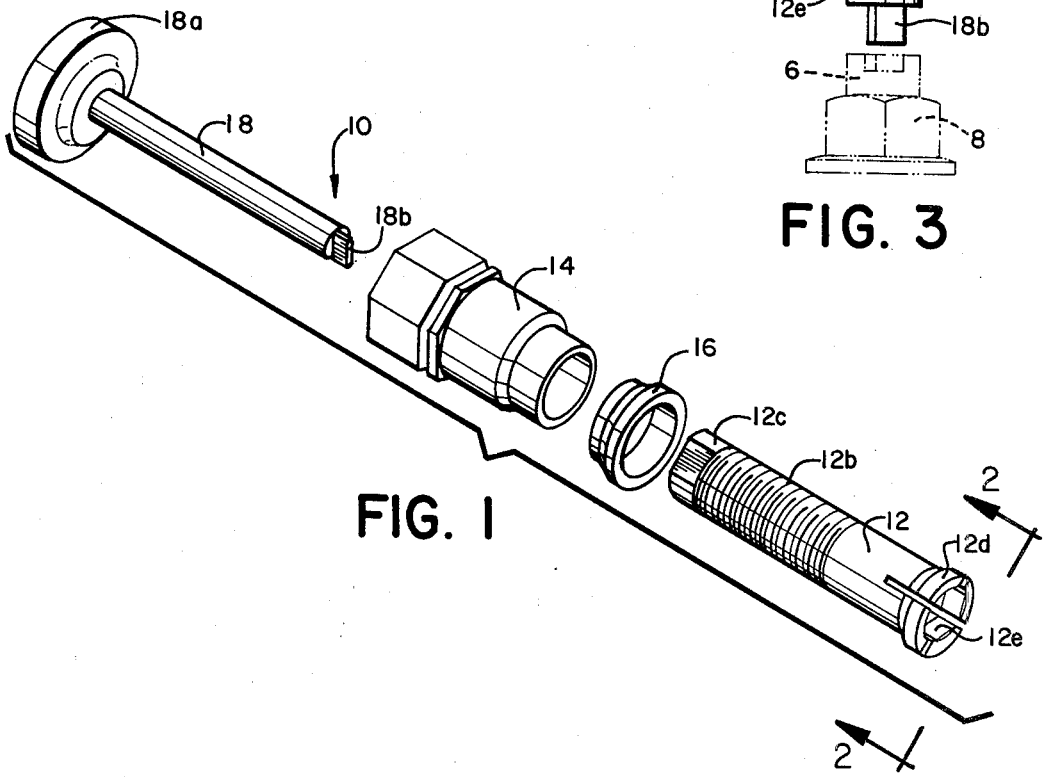
FIG. 1 is an exploded isometric view of a valve adjustment tool in accordance with the invention.

Referring to FIGS. 1 and 3, the device 10 includes a barrel 12 having a central through-bore 12*a*. The upper half of the barrel 12 is provided with external threads 12*b*. The upper end of the barrel 12 is also provided with a flat tool land 12*c*. The lower end of the barrel 12 is provided with a collet 12*d* shaped to form a flexible split sided socket 12*e* which is sized to accommodate a valve lock nut 8 of an engine.

A sleeve 14 is also provided. The sleeve has internal threads 14*a* which engage the external threads 12*b* of the barrel 12. The upper end of the sleeve 14 is provided with an enlarged diameter tool land 14*b*. The lower portion of the sleeve 14 is provided with an enlarged internal diameter 14*c*.

A slidable compressor collar 16 is also provided. The collar 16 fits over the barrel 12 below the sleeve 14 and surrounds the collet 12*d* on the lower end of the barrel 12.

A valve adjuster driver 18 is also provided. The upper end of the driver 18 is provided with a relatively large disc shaped knob 18*a*. The knob 18*a* serves as a resting place for the measuring foot of a dial indicator (not shown) and provides the means by which the driver 18 can be rotated by a user. The lower end of the driver 18 is provided with a male (or female) stem engagement lug 18*b*. The lug 18*b* engages the valve adjuster stem 6. The driver 18 reposes within the central bore 12*a* of the barrel 12 and is freely rotatable therein and removable therefrom.

In use, the driver 18 is withdrawn a sufficient amount to allow the collet 12*d* of the barrel 12 to engage the lock nut 8. The sleeve 14 is then threaded downwardly to thereby force the collar 16 completely over the collet 12*d* of the barrel to thereby squeeze the collet 12*d* snugly against the nut 8. The barrel 12 and the nut 8 are now efficiently joined together. The nut 8 may be tightened or loosened by applying a tool to the land 12*c* of the barrel 12. (The sleeve 14 turns with the barrel 12 because of friction effects in the threads 12*b* and 14*a*. ) The driver 18 is then pushed downwardly until the valve stem 6 is engaged by the lug 18*b*.

Once the barrel 12 is secured to the valve nut 8 and the lug 18*b* of the driver 18 engages the valve stem 6 and the foot of a dial indicator (not shown) is brought into contact with the flat top of the knob 18*a*, the barrel 12 can be turned with a wrench applied at the tool land 12*c* to loosen the lock nut 8.

Thereafter, the driver 18 can be turned until the dial indicator signals that the stem 6 has been turned to the correct or desired setting, and the barrel 12 is then turned to tighten the lock nut 8.

The device 10 may be removed from the lock nut 8 without disturbing the tightness of the lock nut 8 by removing the dial indicator foot away from the knob 18*a*, and withdrawing the driver 18 from engagement with the stem 6. Thereafter, the sleeve 14 may be partially unthreaded from the barrel 12 by holding the barrel stationary with a tool applied at the land 12*c*, and then threading the sleeve 14 upwardly such that it backs away from the collar 16. The spring force inherent in the collet 12*d* of the barrel 12 forces the collar 16 upward and allows the collet 12*d* to flare away from the nut 8, thereby releasing the grip of the barrel 12 on the nut 8.

It should be noted that the slightly enlarged internal diameter 14*c* provided within the lower portion of the sleeve 14 allows for the bowing effect induced into the barrel 12 when the collet 12*d* is compressed by the collar 16. Hence binding is prevented.

I claim:

1. A tool comprising:

a barrel having a bore therethrough and provided with a collet portion at its lower end and external threads intermediate the ends of the barrel;

a collar overlaying and surrounding said collet portion and movable between a first position wherein said collet portion is compressed and a second position wherein said collet portion is uncompressed;

an internally threaded sleeve threadably engaging said barrel, the lower end of said sleeve confronting the upper end of the collar; and a rotatable and axially adjustable driver reposing within the bore of the barrel, said driver having an upper end provided with an enlarged disc shaped knob and having a lower end provided with an object engaging means.

2. A tool according to claim 1 wherein:

said collet portion comprises a nut engaging socket having vertically disposed slots in the sidewalls of the socket.

3. A tool according to claim 2 wherein:

the internal diameter of the lower portion of the sleeve is larger than the internal diameter of the upper portion of the sleeve and the internal threads of the sleeve are located along the smaller diameter upper portion of the sleeve.

4. A tool according to claim 1 wherein:

said barrel is provided with a tool land at its upper end and said land extends above the top of said sleeve.

* * * * *